US010172192B2

(12) United States Patent
Li et al.

(10) Patent No.: US 10,172,192 B2
(45) Date of Patent: Jan. 1, 2019

(54) LED LAMP SINGLE LIVE WIRE INTELLIGENT CONTROL APPARATUS

(71) Applicant: SHENZHEN POWER2CONTROL SMART TECH CO., LTD, Shenzhen (CN)

(72) Inventors: Hui Li, Shenzhen (CN); Long Zhao, Huizhou (CN)

(73) Assignee: SHENZHEN POWER2CONTROL SMART TECH CO., LTD, Shenzhen (CN)

( * ) Notice: Subject to any disclaimer, the term of this patent is extended or adjusted under 35 U.S.C. 154(b) by 0 days.

(21) Appl. No.: 15/779,855

(22) PCT Filed: Sep. 12, 2016

(86) PCT No.: PCT/CN2016/098767

§ 371 (c)(1),
(2) Date: May 30, 2018

(87) PCT Pub. No.: WO2017/156991

PCT Pub. Date: Sep. 21, 2017

(65) Prior Publication Data

US 2018/0352618 A1 Dec. 6, 2018

(30) Foreign Application Priority Data

Mar. 18, 2016 (CN) ..... 2016 1 0155633

(51) Int. Cl.
*H05B 33/08* (2006.01)

(52) U.S. Cl.
CPC ..... *H05B 33/0809* (2013.01)

(58) Field of Classification Search
CPC ..... H05B 33/0815; H05B 33/0818; H05B 33/0884; H05B 33/0809; H05B 33/0848; H05B 33/0857; H05B 33/0887
See application file for complete search history.

(56) References Cited

U.S. PATENT DOCUMENTS

2014/0346954 A1 11/2014 Li et al.
2016/0099773 A1* 4/2016 Raj ..... H04B 10/116 398/118

(Continued)

FOREIGN PATENT DOCUMENTS

CN 201884990 U 6/2011
CN 105611679 A 5/2016
CN 205430694 U 8/2016

OTHER PUBLICATIONS

International Search Report for PCT/CN2016/098767.

(Continued)

*Primary Examiner* — Douglas W Owens
*Assistant Examiner* — Syed M Kaiser

(57) ABSTRACT

A light-emitting diode (LED) lamp single live wire intelligent control apparatus includes at least one first LED lamp half-wave driving device, a single live wire control circuit connected in series on a same alternating current (AC) loop, and a control output circuit. Or the LED lamp single live wire intelligent control apparatus includes one second LED lamp half-wave driving device and a single live wire control circuit connected in series on a same AC loop.

4 Claims, 8 Drawing Sheets

(56) References Cited

U.S. PATENT DOCUMENTS

| | | | | |
|---|---|---|---|---|
| 2016/0164253 | A1* | 6/2016 | Nakamura | H01S 5/0427 372/38.02 |
| 2016/0165678 | A1* | 6/2016 | Sudhaus | H05B 33/083 315/161 |
| 2017/0202062 | A1* | 7/2017 | Choi | H05B 33/0854 |
| 2017/0279300 | A1* | 9/2017 | Catalano | H02J 7/0068 |

OTHER PUBLICATIONS

International Publication for PCT/CN2016/098767.
Written Opinion of the International Searching Authority for PCT/CN2016/098767.

* cited by examiner

LED LAMP SINGLE LIVE WIRE INTELLIGENT CONTROL APPARATUS

BACKGROUND OF INVENTION

1. Field of Invention

The present disclosure relates to the lighting control field of smart home, and more particularly to a light-emitting diode (LED) lamp single live wire intelligent control apparatus.

2. Description of Prior Art

A smart home and lighting control are rapidly popularized to ordinary people. If the intelligent lighting control is achieved without decoration, a single live wire installation mode has to be adopted. At present, in aspect of the single live wire electronic and intelligent control technologies, technology that weak leakage current of lamp is used for providing working electricity of a signal live wire control panel is generally adopted, and the single live wire of the technology is adopted. "Turn-off" of the lamp does not really turn off, and "turn-off" of the lamp is that people eyes do not see the light in power-on status with extremely small leakage current.

However, when the weak leakage of the signal live wire control panel does not match with the lowest weak leakage of "non-luminance" of the lamp (it is common phenomenon), light of the lamp will be in flickering status, which has become the largest development obstacle in the industry.

SUMMARY OF INVENTION

The aim of the present disclosure is to use half-wave power supply of diode and series control technology according to input voltage of a light-emitting diode (LED) lamp having wide range to achieve smart control for large current and single live wire of the LED lamp.

A first technology scheme is as follow:

An LED lamp single live wire intelligent control apparatus comprises at least one first LED lamp half-wave driving device, a single live wire control circuit connected in series on a same alternating current (AC) loop, and at least one group of control output circuit.

The first LED lamp half-wave driving device comprises a first direct current (DC) driver and a first rectifier diode connected in parallel with the first DC driver of first LED lamp.

The single live wire control circuit comprises a half-wave DC power supply circuit and a first central processing unit (CPU) control circuit. The half-wave DC power supply circuit comprises a first DC power circuit and a second rectifier diode connected in parallel with the first DC power circuit. A conduction direction of the second rectifier diode in an AC loop is opposite to the conduction direction of the first rectifier diode of the first LED lamp half-wave driving device in the same AC loop.

The control output circuit comprises at least one first switch element and a third rectifier diode connected in parallel with the first switch element.

A conduction direction of the third rectifier diode in the AC loop is same to the conduction direction of the first rectifier diode of the first LED lamp half-wave driving device in the same AC loop.

The first switch element is a relay, a silicon controlled rectifier, an insulated gate bipolar translator (IGBT), or a mechanical switch.

The first switch element is controlled by the first CPU control circuit or by a manual triggering way.

A second technology scheme is as follow:

An LED lamp single live wire intelligent control apparatus comprises at least one second LED lamp half-wave driving device and a single live wire control circuit connected in series on a same alternating current (AC) loop.

The second LED lamp half-wave driving device comprises a second direct current (DC) driver and a fourth rectifier diode connected in parallel with the second DC driver of second LED lamp.

The single live wire control circuit comprises a half-wave power supply output circuit and a second CPU control circuit. The half-wave power supply output circuit comprises a second DC power circuit and a fifth rectifier diode connected in series with a second switch element. The second DC power circuit is connected in parallel with the fifth rectifier diode and the second switch element.

A conduction direction of the fifth rectifier diode in the AC loop is opposite to the conduction direction of the fourth rectifier diode of the second LED lamp half-wave driving device in the same AC loop.

The second switch element is a relay, a silicon controlled rectifier, an insulated gate bipolar translator (IGBT), or a mechanical switch.

The second switch element is controlled by the first CPU control circuit or by a manual triggering way.

Beneficial Effect

The present disclosure uses the single live wire control circuit and the control output circuit in the LED lamp single live wire intelligent control apparatus to control and output AC have-wave to turn on, further providing normal drive power supply for the LED lamp. The present disclosure uses the half-wave power supply of diode and series control technology according to input voltage of a light-emitting diode (LED) lamp having wide range to achieve smart control for large current and single live wire of the LED lamp.

The present disclosure uses AC half-wave alternating conduction and shunt power supply principle. The present disclosure completely uses that DC power supply of the LED lamp DC driver and the CPU control circuit is within an effective value range of an AC input voltage on or above 80V-110V to normal work, when single group of the AC half-wave turns on, the drive power supply is provided for the LED lamp. At the same time, when the other single group of the AC half-wave turns on, the DC power supply is provided for the CPU control circuit. As power supply loop of the DC power supply of the LED lamp DC driver and the CPU control circuit is completely independent based on alternating timing sequence misalignment of the AC half-wave, which is not restriction and affected by each other.

The present disclosure completely solves critical defect of normal weak leakage-type single live wire light controller. The present disclosure is simple stable, and cheap. The present disclosure has extremely high application value in smart home and intelligent lighting control.

Figure 1:
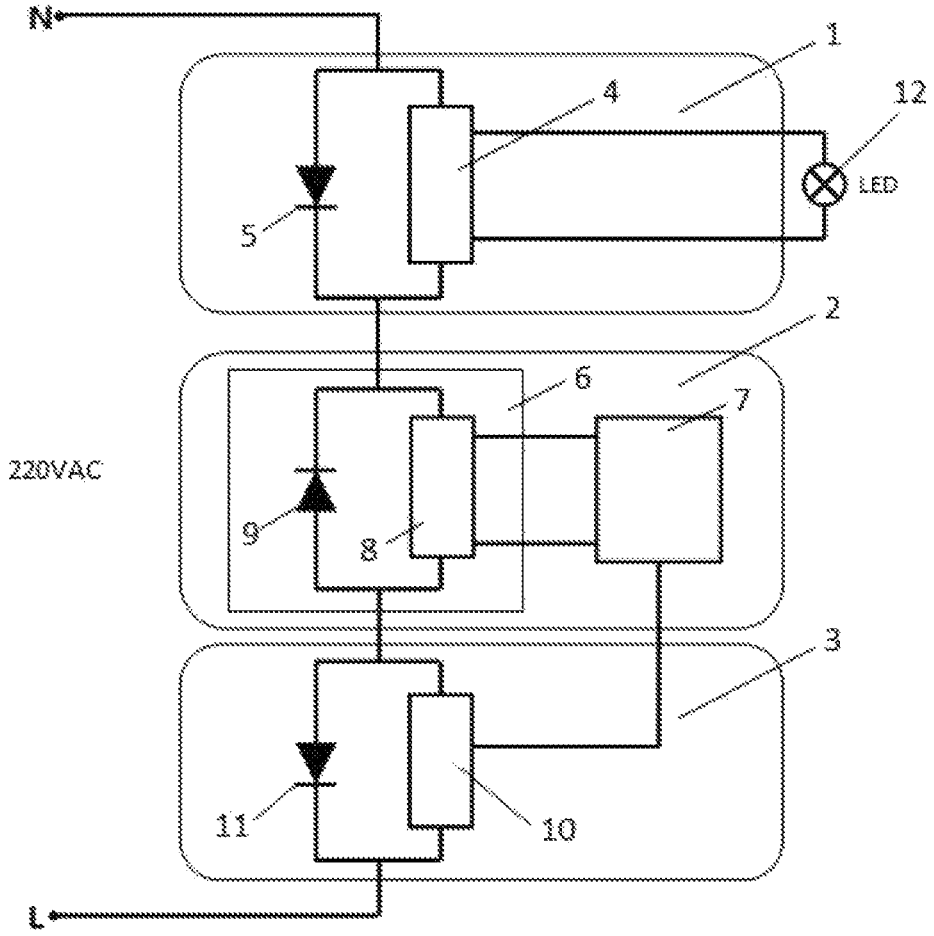
FIG. 1 is a schematic diagram of a first embodiment of the present disclosure.

Wherein: first LED lamp half-wave driving device 1; single live wire control circuit 2; control output circuit 3; first DC driver 4; first rectifier diode 5; half-wave DC power supply circuit 6; first central processing unit (CPU) control circuit 7; first DC power circuit 8; second rectifier diode 9; first switch element 10; third rectifier diode 11; first LED lamp 12; second LED lamp half-wave driving device 101; single live wire control circuit 201; second DC driver 301; fourth rectifier diode 401; half-wave power supply output circuit 501 second central processing unit CPU control circuit 601; second DC power circuit 701; fifth rectifier diode 801; second switch element 901; and second LED lamp 13.

DETAILED DESCRIPTION OF PREFERRED EMBODIMENTS

First Embodiment (A First Technical Scheme)

As shown in FIG. 1-FIG. 4, a light-emitting diode (LED) lamp single live wire intelligent control apparatus comprises at least one first LED lamp half-wave driving device 1, a single live wire control circuit 2 connected in series on a same alternating current (AC) loop, and at least one group of control output circuit 3.

The first LED lamp half-wave driving device 1 comprises a first direct current (DC) driver 4 and a first rectifier diode 5 connected in parallel with the first DC driver 4 of a first LED lamp 12.

The single live wire control circuit 2 comprises a half-wave DC power supply circuit 6 and a first central processing unit (CPU) control circuit 7. The half-wave DC power supply circuit 6 comprises a first DC power circuit 8 and a second rectifier diode 9 connected in parallel with the first DC power circuit 8. The first DC power circuit 8 provides power source for the first CPU control circuit 7. A conduction direction of the second rectifier diode 9 in the AC loop is opposite to the conduction direction of the first rectifier diode 5 of the first LED lamp half-wave driving device 1 in the AC loop.

The control output circuit 3 comprises at least one first switch element 10 and a third rectifier diode 11 connected in parallel with the first switch element 10.

A conduction direction of the third rectifier diode 11 in the AC loop is same to the conduction direction of the first rectifier diode 5 of the first LED lamp half-wave driving device 1 in the AC loop.

The first switch element 10 is a relay, a silicon controlled rectifier, an insulated gate bipolar translator (IGBT), or a mechanical switch.

The first switch element 10 is controlled by the first CPU control circuit 7 or by a manual triggering way.

Figure 2:
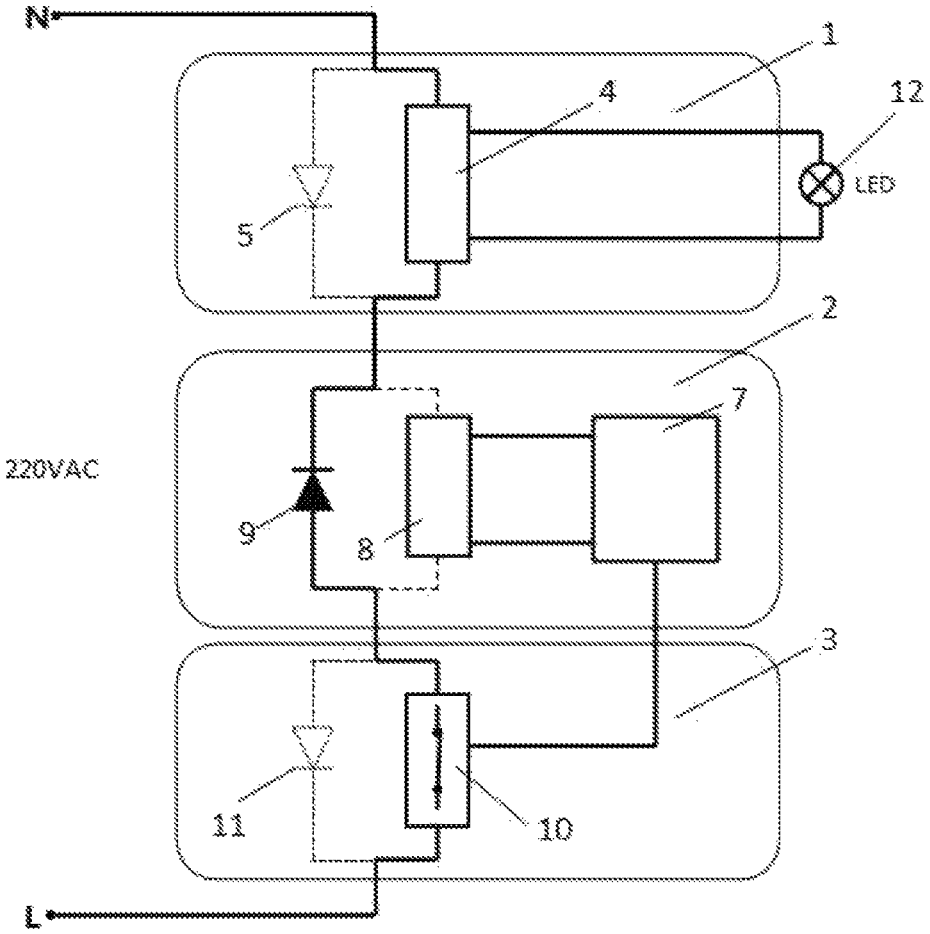
FIG. 2 is a first schematic diagram of the first embodiment in a turn-light-on status of the present disclosure.

As shown in FIG. 2, the LED lamp single live wire intelligent control apparatus is in turn-light-on status: the first switch element 10 turns on, a forward AC half-wave forms a conduction loop through the first switch element 10, the second rectifier diode 9 and the first DC driver 4 of the first LED lamp 12. The first DC driver 4 provides the power source to the first LED lamp 12 and the first LED lamp 12 turns on, at the same time, the first DC power circuit 8 is in a bypass status.

Working voltage of the first DC power circuit 8 is within an effective value range of an AC input voltage on or above 80V-110V, thus, normal output can be maintained when the AC half-wave is in the bypass status.

Figure 3:
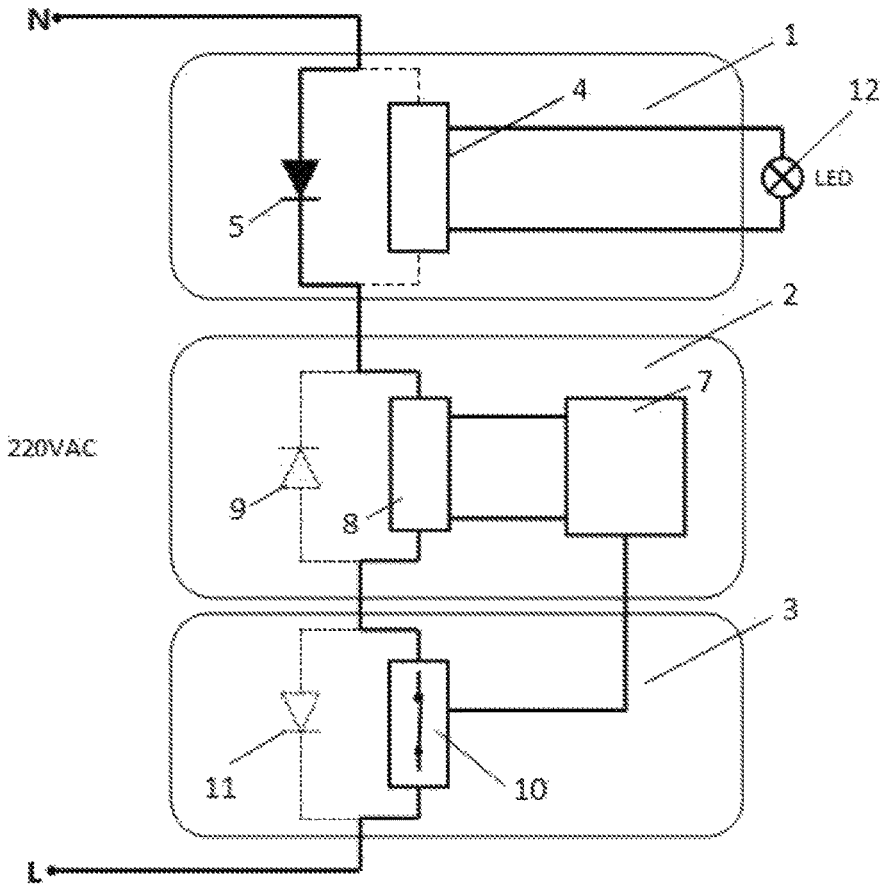
FIG. 3 is a second schematic diagram of the first embodiment in a turn-light-on status of the present disclosure.

As shown in FIG. 3, when the first CPU control circuit 7 controls the first switch element 10 to turn on, the LED lamp single live wire intelligent control apparatus is in turn-light-on status, at this time, a reverse AC half-wave forms a conduction loop through the first rectifier diode 5, the first switch element 10, and the first DC power circuit 8. At the same time, the first DC driver 4 of the first LED lamp 12 is in a bypass status.

Working voltage of the first DC driver 4 is within an effective value range of the AC input voltage on or above 80V-110V, thus, normal output can be maintained when the AC half-wave is in the bypass status.

Figure 4:
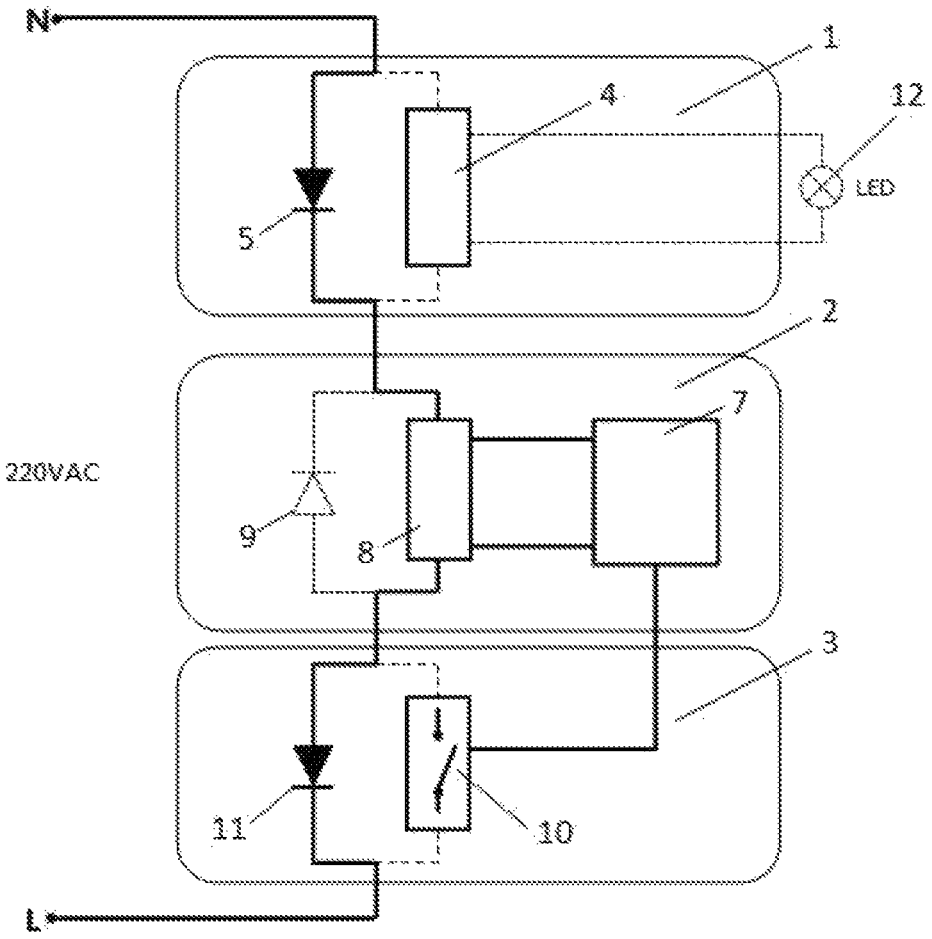
FIG. 4 is a schematic diagram of the first embodiment in a turn-light-off status of the present disclosure.
Figure 5:
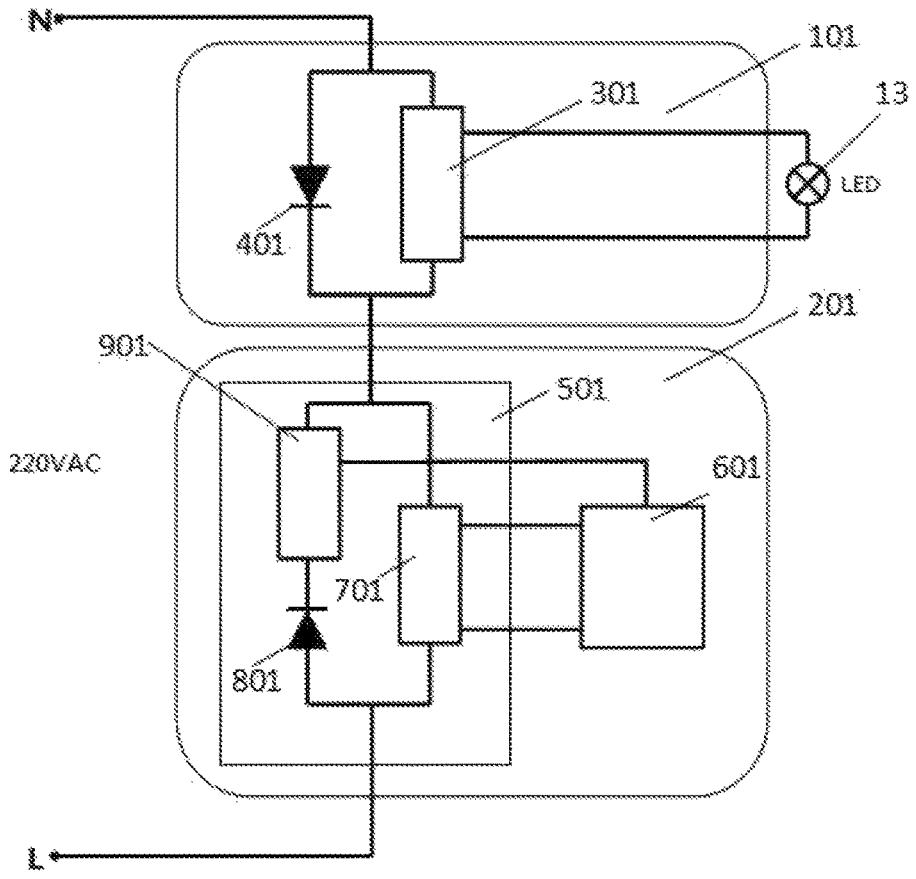
FIG. 5 is a schematic diagram of a second embodiment of the present disclosure.

As shown in FIG. 4, when the first CPU control circuit 7 controls the first switch element 10 to be in an broken circuit status, the LED lamp single live wire intelligent control apparatus is in turn-light-off status, at this time, the first DC driver 4 of the first LED lamp 12 cannot obtain a forward power supply due to the broken circuit. When the AC half-wave is reversed, the first rectifier diode 5 makes the first DC driver 4 of the first LED lamp 12 be in the bypass status. Thus, the first DC driver 4 is complete in the broken circuit status, the first DC driver 4 cannot provide the power supply to the first LED lamp 12, and the first LED lamp 12 turns off. At the same time, the first rectifier diode 5, the third rectifier diode 11, and the first DC power circuit 8 form the conduction loop to provide half-wave power supply to the first DC power circuit 8.

In an actual case, connection direction of all rectifier diodes can be opposite to the above embodiment.

Second Embodiment (A Second Technical Scheme)

As shown in FIG. 5-FIG. 8, an LED lamp single live wire intelligent control apparatus comprises at least one second LED lamp half-wave driving device 101 and a single live wire control circuit 201 connected in series on a same AC loop.

The second LED lamp half-wave driving device 101 comprises a second DC driver 301 and a fourth rectifier diode 401 connected in parallel with the second DC driver 301 of the second LED lamp 13.

The single live wire control circuit 201 comprises a half-wave power supply output circuit 501 and a second CPU control circuit 601. The half-wave power supply output circuit 501 comprises a second DC power circuit 701 and a fifth rectifier diode 801 connected in series with a second switch element 901. To be specific, the second DC power circuit 701 is connected in parallel with the fifth rectifier diode 801 and the second switch element 901. The second DC power circuit 701 provides power source for the second CPU control circuit 601.

A conduction direction of the fifth rectifier diode 801 in the AC loop is opposite to the conduction direction of the fourth rectifier diode 401 of the second LED lamp half-wave driving device 101 in the AC loop.

The second switch element 901 is a relay, a silicon controlled rectifier, an insulated gate bipolar translator (IGBT), or a mechanical switch. The second switch element 901 is controlled by the second CPU control circuit 601 or by a manual triggering way.

Figure 6:
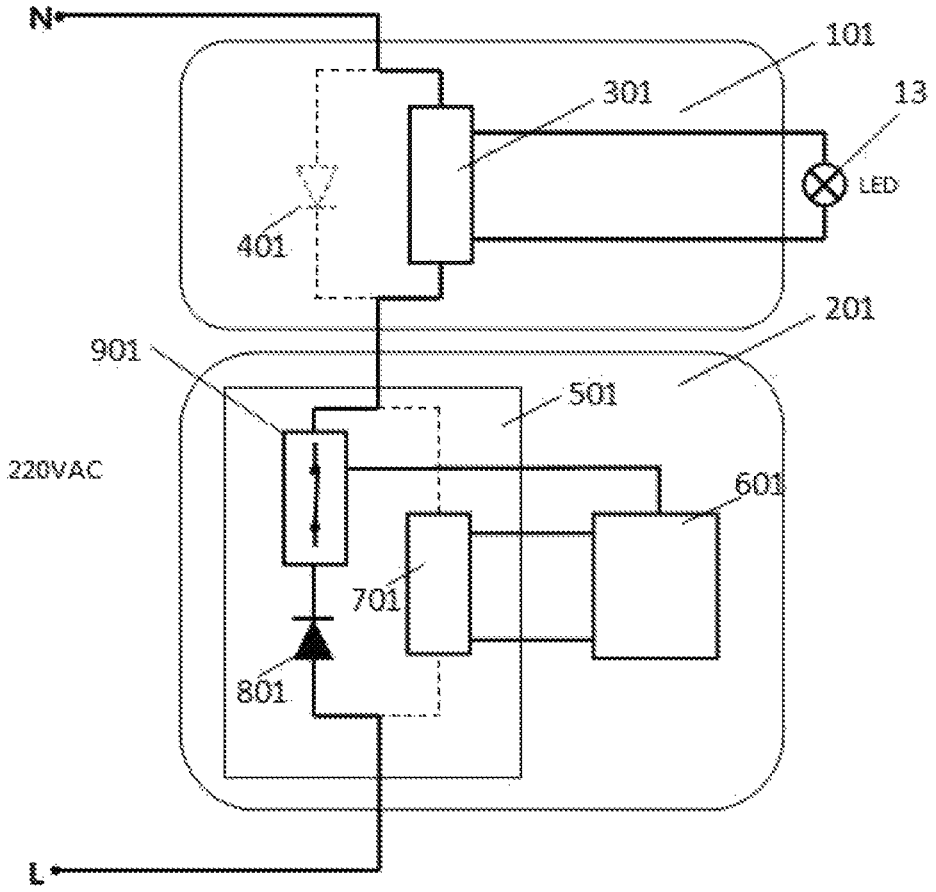
FIG. 6 is a first schematic diagram of the second embodiment in a tumor-light-on status of the present disclosure.

As shown in FIG. 6, when the second CPU control circuit 601 controls the second switch element 901 to turn on, the LED lamp single live wire intelligent control apparatus is in turn-light-on status, at this time, a forward AC half-wave forms a conduction loop through the second switch element 901, the fifth rectifier diode 801, and the second DC driver 301 of the second LED lamp 13, namely the second DC driver 301 provides the power supply for the second LED lamp 13, and the second LED lamp 13 turns on. At the same time, the second DC power circuit 701 is in a bypass status.

Working voltage of the second DC power circuit 701 is within an effective value range of an AC input voltage on or above 80V-110V, thus, normal output can be maintained when the AC half-wave is in the bypass status.

Figure 7:
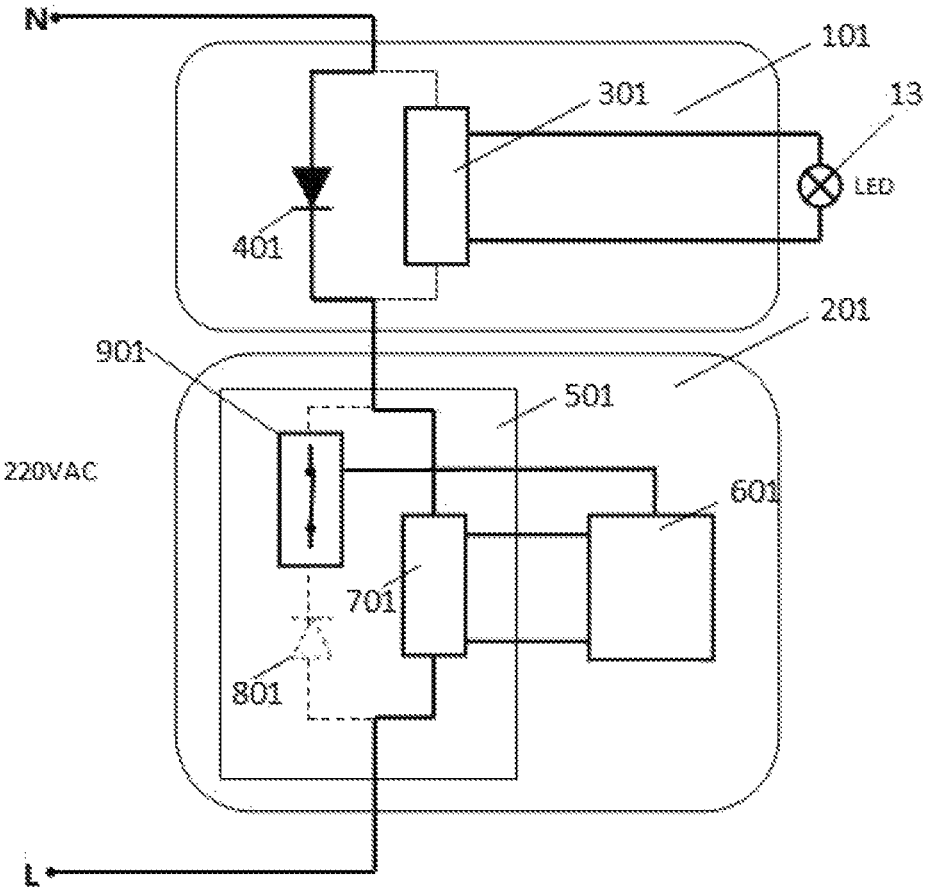
FIG. 7 is a second schematic diagram of the second embodiment in a turn-light-on status of the present disclosure.

As shown in FIG. 7, the LED lamp single live wire intelligent control apparatus is in turn-light-on status, as the second switch element 901 turns on, when the second CPU control circuit controls the second switch element 901 to be in the broken circuit status, the LED lamp single live wire intelligent control apparatus is in the turn-light-off status, at this time, a reverse AC half-wave forms a conduction loop through the fourth rectifier diode 401, the second switch element 901 and the second DC power circuit 701. At the same time, the second DC driver 301 of the second LED lamp 13 is in a bypass status.

Working voltage of the second DC driver 301 is within an effective value range of the AC input voltage on or above 80V-110V, thus, normal output can be maintained when the AC half-wave is in the bypass status.

Figure 8:
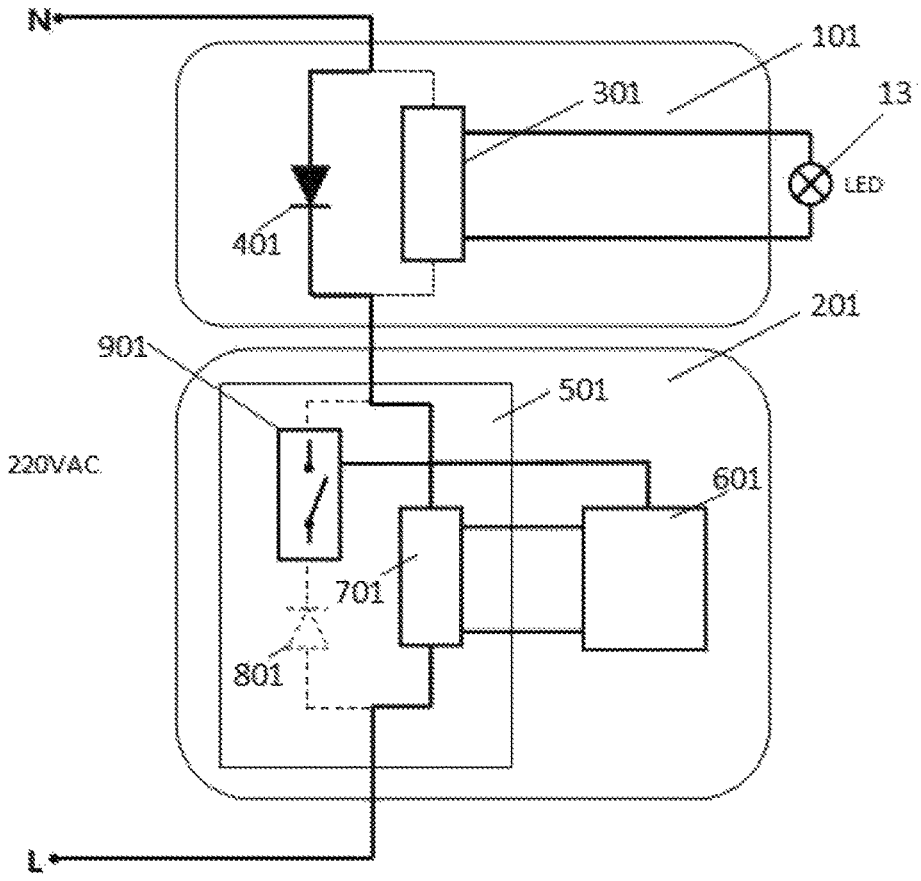
FIG. 8 is a schematic diagram of the second embodiment in a turn-light-off status of the present disclosure.

As shown in FIG. 8, the LED lamp single live wire intelligent control apparatus is in turn-light-off status, as the second switch element 901 is in the broken circuit status, when the AC half-wave is reversed, the second DC driver 301 of the second LED lamp 13 cannot obtain a forward power supply due to the broken circuit. When the AC half-wave is reversed, the fourth rectifier diode 401 makes the second DC driver 301 of the second LED lamp 13 be in the bypass status. Thus, the second DC driver 301 of the second LED lamp 13 is complete in the broken circuit status, the second DC driver 301 cannot provide the power supply to the second LED lamp 13, and the second LED lamp 13 turns off. At the same time, the fourth rectifier diode 401 and the second DC power circuit 701 form the conduction loop to provide half-wave power supply to the second DC power circuit 701.

In an actual case, connection direction of all rectifier diodes can be opposite to the above embodiment.

As the above, the LED lamp single live wire intelligent control apparatus provided by the embodiment of the present disclosure is described in detail. A person skilled in art, the specific embodiment and applied range both can be changed. The present disclosure has been described with reference to certain preferred and alternative embodiments which are intended to be exemplary only and do not limit the full scope of the present disclosure as set forth in the appended claims.

What is claimed is:

1. A light-emitting diode (LED) lamp single live wire intelligent control apparatus, comprising:

at least one first LED lamp half-wave driving device, a single live wire control circuit connected in series on a same alternating current (AC) loop; and at least one group of control output circuit;

wherein the first LED lamp half-wave driving device comprises a first direct current (DC) driver and a first rectifier diode connected in parallel with the first DC driver of first LED lamp;

wherein the single live wire control circuit comprises a half-wave DC power supply circuit and a first central processing unit (CPU) control circuit; the half-wave DC power supply circuit comprises a first DC power circuit and a second rectifier diode connected in parallel with the first DC power circuit; a conduction direction of the second rectifier diode in an AC loop is opposite to the conduction direction of the first rectifier diode of the first LED lamp half-wave driving device in the same AC loop;

wherein the control output circuit comprises at least one first switch element and a third rectifier diode connected in parallel with the first switch element.

2. The LED lamp single live wire intelligent control apparatus as claimed in claim 1, wherein a conduction direction of the third rectifier diode in the AC loop is same to the conduction direction of the first rectifier diode of the first LED lamp half-wave driving device in the same AC loop.

3. The LED lamp single live wire intelligent control apparatus as claimed in claim 1, wherein the first switch element is a relay, a silicon controlled rectifier, an insulated gate bipolar translator (IGBT), or a mechanical switch.

4. The LED lamp single live wire intelligent control apparatus as claimed in claim 1, wherein the first switch element is controlled by one of the first CPU control circuit and a manual triggering way.

* * * * *